United States Patent [19]

Huber et al.

[11] Patent Number: 4,570,146

[45] Date of Patent: Feb. 11, 1986

[54] HIGH VOLTAGE FUSE

[76] Inventors: William J. Huber, S35 W27560 Country Club Ct., Waukesha, Wis. 53186; William E. Barry, 13520 Keefe Ave., Brookfield, Wis. 53005

[21] Appl. No.: 622,965

[22] Filed: Jun. 21, 1984

[51] Int. Cl.[4] ..... H01H 85/04

[52] U.S. Cl. ..... 337/158; 337/234; 337/251

[58] Field of Search ..... 337/158, 159, 234, 235, 337/251, 252, 253

[56] References Cited

U.S. PATENT DOCUMENTS 3,846,728 11/1974 Salzer ..... 337/159

*Primary Examiner*—Harold Broome

*Attorney, Agent, or Firm*—Ronald E. Barry

[57] ABSTRACT

A high voltage fuse having a fuse assembly embedded in a granular dielectric material within a cylindrical dielectric housing, the fuse assembly including a number of fuse support surfaces, a support ring at each end of the plates to hold the plates in on equally spaced radial rotation, a conductive plate secured to each of said rings and including a threaded boss, a fuse element helically wound around said support surfaces and being electrically connected to said support plates, an electrically conductive end cap having a threaded stud and being mounted at one end of said housing, whereby the boss on one end of said fuse assembly is connected to said stud.

18 Claims, 8 Drawing Figures

HIGH VOLTAGE FUSE

BACKGROUND OF THE INVENTION

In the construction of current limiting fuses for application outdoors, it is desirable to have a design which is impervious to the entrance of moisture. Moisture inside of a fuse could cause a malfunction when called upon to clear a fault occurring on the electrical system. Malfunction of the fuse could be caused by the heat of the arc in the fuse turning the moisture therein to steam with sufficient internal pressure to rupture the fuse housing. Moisture can also cause the dielectric strength of the internal parts of the fuse to degrade to a level which would allow tracking and flashover to occur during high voltage withstand following fuse interruption of a fault current.

Current limiting fuses presently available generally require an electric current interchange between the fuse assembly and the end caps of the fuse. This interchange is generally provided by tabs on the winding assembly protruding through openings in the end caps and being soldered to the end caps or alternately having one of the fuse elements of the winding assembly protruding through an opening in the cap and being soldered to the end cap. In both of these examples, the end cap integrity against ingress of moisture has been violated by the openings provided in the end cap. The openings may be sealed during production by soldering but over a period of years, leaks may occur due to physical deterioration of the solder in the opening. When the soldering is done after the fuse has been assembled, the heat used during soldering can expand the end cap at a faster rate than the nonmetallic fuse tube stressing the epoxy joints and producing leakage.

Flexible conducting metal tabs attached to the end plates have been used to provide electrical connections to the end caps. The tabs are bent to engage the end caps which produces a compression fit. This produces a compression connection which is hard to control due to production tolerances of the parts. Where the flexible conducting metal tabs have been used to provide electrical connection to the end caps, failures have also occurred due to the relaxing or cold flow of the compression joints over a period of years.

SUMMARY OF THE INVENTION

The current limiting fuse according to the present invention has improved moisture penetration resistance and can be quickly and easily assembled during production. Only one of the end caps is used to make electrical connection to the fuse assembly. This is accomplished without penetrating the end cap surface. The other end cap can be formed as a part of the housing or from a nonconducting material. Electrical connection is made to the other end of the fuse assembly by an electrically conductive member connected directly to the end plate of the fuse assembly and extending through an opening in the center of the end cap. An even distribution of current to the fuse elements is provided by the unique design of the end plates of the fuse assembly.

IN THE DRAWINGS

FIG. 1 is a section view in elevation showing the high voltage fuse according to the present invention.

FIG. 2 an enlarged view of the end of the fuse assembly attached to the inside of the end cap.

DETAILED DESCRIPTION OF THE INVENTION

Figure 1:
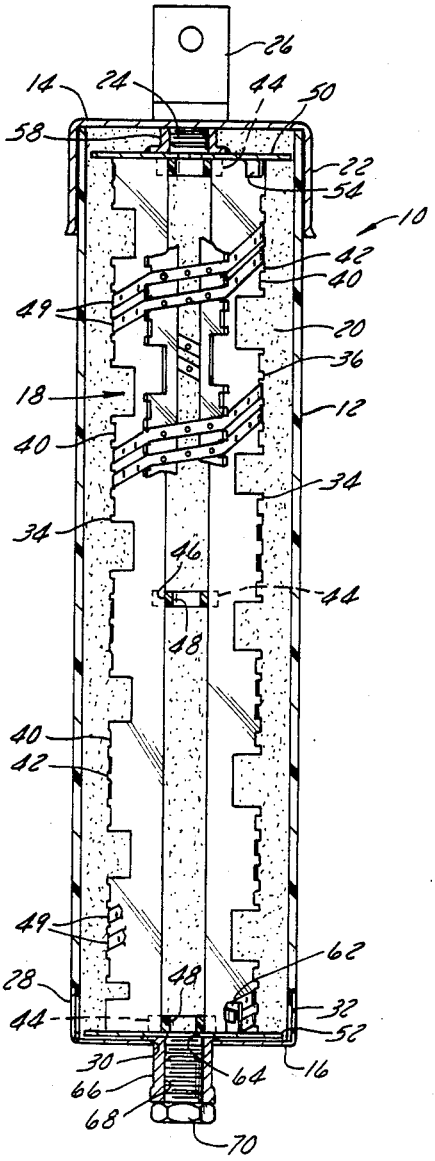
Figure 2:
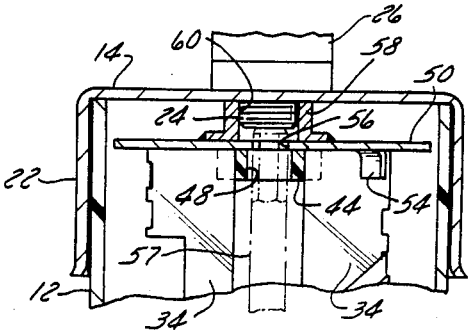
Figure 5:
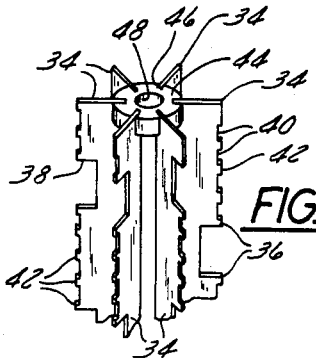
FIG. 5 is a perspective view of a portion of the fuse assembly showing one of the spacer rings for supporting the dielectric support plates.
Figure 4:
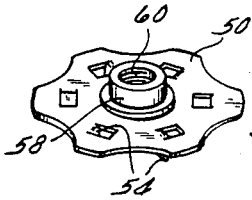
FIG. 4 is a perspective view of the end plate which is attached to the inside of the end cap.
Figure 3:
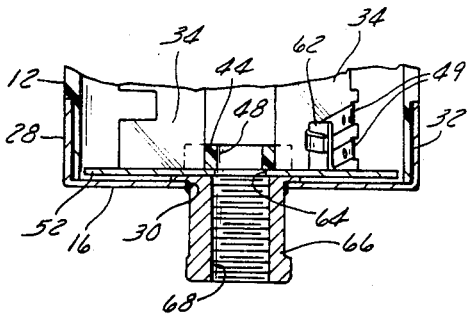
FIG. 3 is an enlarged view of the end of the fuse assembly which extends through the end cap.

Referring to FIG. 1 of the drawings, the current limiting fuse 10 according to the invention generally includes a cylindrical insulating housing 12 having an electrically conductive end cap 14 closing one end of the housing and an end cap 16 closing the other end of the housing. A fuse assembly 18 is supported within the housing between the end caps 14 and 16 and is embedded in a granular dielectric material 20. The housing 12 is generally formed from a dielectric material such as a plastic resin of sufficient strength to withstand normal operating pressures of the fuse. The end cap 14 is provided with a peripheral flange 22 which is sealed to the outside surface of the housing 12 as described below and a threaded stud 24 centrally located on the inside surface of the end cap. A conductive contact 26 is secured to the outside surface of the end cap 14. The end cap 16 is provided with a peripheral flange 28 to matingly engage the outside surface of the housing 12 and has a central aperture 30. The end cap 16 as seen in FIG. 3 is mounted on a reduced diameter section 32 of the housing 12 to provide an uninterrupted surface with the outside surface of the housing 12.

The fuse assembly 18 includes a number of high dielectric high temperature plates 34 made of conventional material. Each of the plates includes a number of generally supportive surfaces 36 separated by notches 38. Each of the support surfaces 36 is separated into a number of tracks 40 by means of tabs 42.

In accordance with one aspect of the invention, the plates 34 are held in equal angular relation by means of spacer rings 44 also made of a conventional dielectric material. Each spacer ring 44 includes a central aperture or bore 48 and a number of equally angularly spaced slots 46. One of the rings 44 is mounted at each end of the assembly and additional spacer rings 44 may be provided intermediate the ends of the plates 34 depending on the length of the fuse assembly. The fuse assembly 18 can be simply and easily assembled by inserting the plates 34 into the slots 46 to form a subassembly that can be easily handled. An electrically conductive end plate 50, 52 is secured to the spacer ring 44 at each end of plates 34 by a conventional adhesive. A number of fuse members 49 are helically wound around the outer periphery of the support members 36 in the tracks 40 defined by the tabs 42 and are secured to the end plates.

Figure 6:
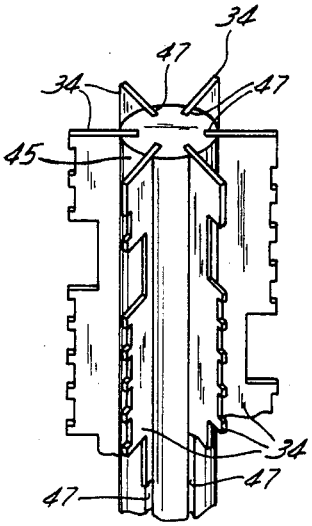
FIG. 6 is a perspective view of a portion of an alternate embodiment of the fuse assembly showing a solid spacer for supporting the support plates.

In the alternate form of the fuse assembly shown in FIG. 6 the support plates are shown supported by means of a spacer rod 45. The rod is made of a dielectric material and includes a number of equal angulary spaced slots 47. The support plates are inserted into the slots 47 as described above.

In this regard, it should be noted that the end plate 50 includes a number of tabs 54 which are punched out of the surface of the plate 50 and a central hexagonal aperture or opening 56. One end of the fuse elements is connected to the tabs 54. A boss 58 is mounted on the end plate 50 and includes a threaded aperture 60 which is aligned with the opening 56 in the end plate 50 and the openings 48 in the space rings 44. Means are provided for tightening the fuse assembly into the stud 24. Such means is in the form of a hex wrench 57 which can be inserted through opening 68 in boss 66 and openings 48 in the spacer rings into engagement with hex opening 56.

The end plate 52 also includes a number of tabs 62 which are punched in the surface of the plate 52 and a central aperture or opening 64. The outer ends of the fuse elements 49 are connected to the tabs 62. A boss 66 is secured to the plate 52 and includes a threaded aperture 68 which is axially aligned with the opening 64 in the end plate 52 and the openings 48 in the spacer rings 44.

Figure 7:
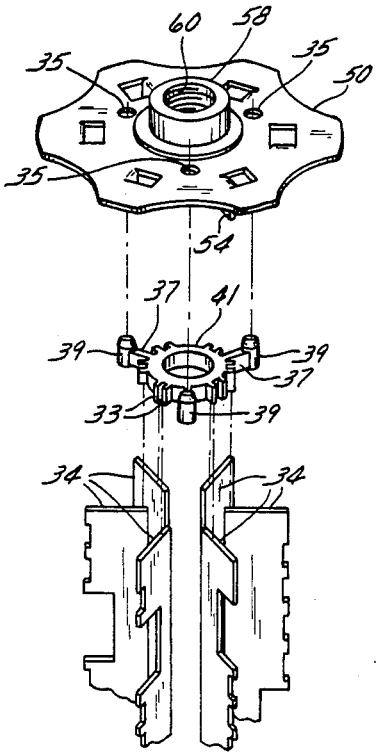
FIG. 7 is an exploded view of one end of the fuse assembly showing an alternate embodiment of one of the spacer rings.
Figure 8:
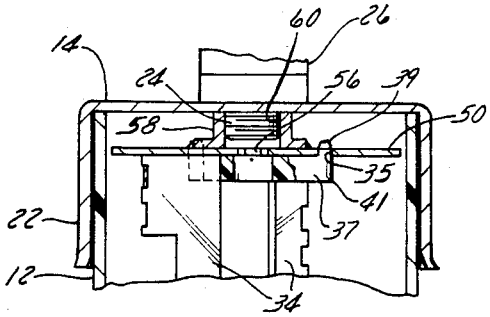
FIG. 8 is a section view of one end of the fuse showing the alternate spacer ring in the fuse assembly.

In the embodiment of the invention shown in FIGS. 7 and 8, an alternate form of spacer ring 41 is shown which is provided with means for mechanically locking the spacer ring to the end plate 50, 52. Such means is in the form of plugs 39 provided on the outer ends of radially extending arms 37. Each of the plugs 39 is located in a position to engage corresponding openings 35 in the plate 50. The spacer ring 41 also includes a number of pairs of tabs 33 for supporting the plates 34. The tabs 33 are spaced apart a distance less than the width of support plates 34 to provide a friction fit for the plates. The plates 50, 52 are secured to the spacer rings with the plugs 39 projecting through the openings 35. With this arrangement, the turning force required to tighten the fuse assembly onto the stud 24 will be taken up by the plugs 39 rather than the adhesive joint.

On assembly, the end cap 14 is secured to the housing 12 by an epoxy adhesive provided between the peripheral flange 22 of the end cap and the outside surface of the housing 12. The fuse assembly 18 is inserted into the housing 12 and the boss 58 screwed onto the threaded stud 24 provided on the inside surface of the end cap 14.

The housing 12 is held in a generally vertical position with the open end of the housing on top. Granular dielectric material 20 can then be poured into the housing until the housing is substantially filled. The level of the material can be observed since the end cap 16 has not been placed on the housing. The end cap 16 is then secured to the reduced diameter section 32 of the housing 12 with the boss 66 on the end cap plate 52 projecting through the opening 30. The end cap 16 is sealed to the housing by providing an epoxy adhesive on the inside of the peripheral flange 28 on the end cap 16. The housing can then be topped off with the granular dielectric material 20 by pouring the material through the threaded opening 68 in the boss 66, the opening 64 in the plate 52 and the opening 48 in the spacer ring 44. It should be noted that the spacer ring is axially aligned with the threaded opening 68 in boss 66 to allow for the free-flow of the granular material into the housing 12. Once the housing has been completely filled, the threaded opening 68 is closed by a plug 70 to seal the housing.

Another advantage of the fuse according to the present invention is the symmetrical distribution of current to the fuse elements 49 through the end plates 50 and 52. In this regard, it will be noted that each of the bosses 58 and 66 is secured directly to the end plates 50 and 52, respectively. Current entering the boss 58 will be symmetrically distributed to each of the fuse element terminations because the conducting paths through the end plates are all identical. Even distribution of the current can be significant particularly when higher frequency currents are present.

It is also within the contemplation of the present invention to use either conductive end caps having a threaded stud at both ends or non-conductive end caps having a hole at both ends of the housing. It should be apparent that the fuse assembly will then require corresponding connectors to accommodate the structure of the end caps.

The embodiments of the invention in which an exclusive property or privilege is claimed, are defined as follows:

1. A high voltage fuse comprising a cylindrical housing, a granular dielectric material in said housing, a fuse assembly embedded in the dielectric material, said fuse assembly including a number of dielectric plates each having a number of fuse support surfaces, means for supporting said plates in an equal angularly spaced relation about a common axis with the support surfaces of adjacent plates being offset, an electrically conductive end plate mounted on each end of said plates, each of said end plates having an electrically conductive member mounted thereon, said members having an internally threaded opening, fuse means helically wound about said support surfaces on said plates and being connected to said end plates, and an end cap secured to both ends of said housing, one of said end caps including an externally threaded stud on the inside surface thereof for engaging one of said electrically conductive members.

2. The fuse according to claim 1 wherein both of said end caps are electrically conductive and said other end cap includes an electrically conductive threaded stud on the inside surface for engaging the internally threaded member on the other of said end plates.

3. The fuse according to claim 1 wherein the other of said end caps includes a central opening, said electrically conductive member on the other of said end plates projecting through said opening whereby an electrical connection can be made directly to the conductive member and said granular dielectric material can be admitted into said housing after assembly through said opening in said conductive member.

4. The fuse according to claim 1, 2 or 3 wherein said support means comprises a number of spacer rings each having a central opening therein in axial alignment with the opening in said electrically conductive member to allow for the free flow of granular material into said housing.

5. The fuse according to claim 1 wherein said support means comprises a solid spacer rod for supporting said plates.

6. The fuse according to claim 4 wherein said spacer rings include means for mechanically connecting said spacer ring to said end plate.

7. A high voltage current limiting fuse comprising a cylindrical housing formed from a high strength dielectric material, an electrically conductive cap mounted on one end of said housing, a fuse assembly positioned in said housing, an electrically conductive boss having a thread opening mounted on each end of said fuse assembly, stud means mounted on the inside surface of said end cap for connecting one of said bosses to said electrically conductive end cap, a granular dielectric material completely filling said housing, and an end cap mounted on the other end of said housing after filling said housing with the dielectric material, said end cap including a centrally located opening, the other one of said bosses projecting through said opening.

8. The fuse according to claim 7 wherein said fuse assembly includes a plurality of dielectric plates and a spacer ring at each end of said plate having radially extending slots for holding said plates in an equal angularly spaced relation.

9. The fuse according to claim 7 wherein said fuse assembly includes a plurality of dielectric plates and a solid spacer rod having radially extending slots for holding said plates in an equal angularly spaced relation.

10. The fuse according to claim 1 wherein said fuse assembly includes a conductive plate at each end and said spacer ring includes means for mechanically locking said spacer rings to said end plates.

11. The fuse according to claim 10 wherein one of said end plates includes a hexagonal opening whereby a hexagonal tool can be inserted into said opening for mechanically turning said fuse assembly onto said stud means on said one of said end caps.

12. A high voltage current limiting fuse comprising a cylindrical housing a fuse assembly positioned in said housing, said assembly including a number of dielectric plates, a number of spacer rings each having radially extending slots for supporting said plates in a fixed relation, each spacer ring including a central opening, a conductive plate secured to a spacer ring at each end of the dielectric plates, each conductive plate including a central opening aligned with the central opening in said fuse assembly, a fuse element helically wound around said dielectric plates and being electrically connected to said conductive plates, an electrically conductive boss secured to each of said conductive plates, each boss including a threaded opening aligned with said opening in said spacer rings, an end cap enclosing each end of said housing, one of said end caps including a threaded stud positioned to engage the conductive boss on one of said conductive plates, and granular dielectric material completely filling said housing.

13. The fuse according to claim 12 wherein said other end cap includes a threaded stud positioned to engage the corresponding threaded opening in said conductive boss on the other of said conductive plates.

14. The fuse according to claim 13 wherein both end caps are electrically conductive.

15. The fuse according to claim 12 wherein the other of said end caps includes a central opening whereby the conductive boss on the other conductive plate can project through said opening.

16. The fuse according to claim 12 wherein said spacer rings include means for mechanically engaging the corresponding conductive plate whereby the rotary force required to tighten the fuse assembly into the stud on said end cap is transferred to said spacer rings from said dielectric plates.

17. The fuse according to claim 12 wherein the central opening in the conductive plate connected to the stud on said end cap is hexagonal whereby the fuse assembly can be secured to the stud by an elongate tool having a hexagonal configuration corresponding to said hexagonal opening inserted through said threaded boss on the other conductive plate and through the spacer rings to engage the hexagonal opening and turn the fuse assembly.

18. A high voltage fuse comprising a cylindrical housing, a granular dielectrical material in said housing, a fuse assembly embedded in said dielectric material, said fuse assembly including a number of dielectric plate each having a number of fuse support surfaces, means for supporting said plates in an equal angularly spaced relation about a common axis with the support surfaces of adjacent plates being offset, an electrically conductive end plate mounted on each end of said plates, each of said end plates having a central opening, a number of tabs equally spaced above the central opening and an electrically conductive member mounted thereon, said member having an internally threaded opening, aligned with the opening in said end plate, a number of fuse members helically wound about said support surfaces on said dielectric plates and operably connected to said tabs whereby current passing through said conductive members will be distributed symmetrically to said fuse elements in passing through said conductive plates, and an end cap secured to both ends of said housing.

* * * * *